United States Patent [19]

Mueller

[11] 4,150,748

[45] Apr. 24, 1979

[54] TAMPERPROOF RECLOSABLE CARTON

[75] Inventor: David C. Mueller, Neenah, Wis.

[73] Assignee: American Can Company, Greenwich, Conn.

[21] Appl. No.: 927,561

[22] Filed: Jul. 24, 1978

[51] Int. Cl.[2] ..... B65D 5/54

[52] U.S. Cl. ..... 206/624; 206/629; 229/33

[58] Field of Search ..... 206/621, 624, 625, 626, 206/629; 229/33

[56] References Cited

U.S. PATENT DOCUMENTS

| | | | |
|---|---|---|---|
| Re. 26,471 | 10/1968 | Meyers | 206/624 |
| 3,125,280 | 3/1964 | Henry | 206/626 |
| 3,294,309 | 12/1966 | Coe | 206/624 |
| 3,378,188 | 4/1968 | Meyers | 206/626 |
| 3,523,636 | 4/1970 | Phillips, Jr. | 206/624 |
| 3,758,023 | 9/1973 | Meyers | 206/624 |
| 4,113,104 | 9/1978 | Meyers | 206/626 |

*Primary Examiner*—Stephen P. Garbe
*Attorney, Agent, or Firm*—Robert P. Auber; Ira S. Dorman; George P. Ziehmer

[57] ABSTRACT

A flip-top carton, which is especially suited for use with ice cream, has a locking reclosure feature, and may be tamperproof. The location of its locking elements facilitates opening, and its design enables the minimization of plies at stress points, so as to avoid cracking of the paperboard from which it is made.

8 Claims, 10 Drawing Figures

FIG. 1
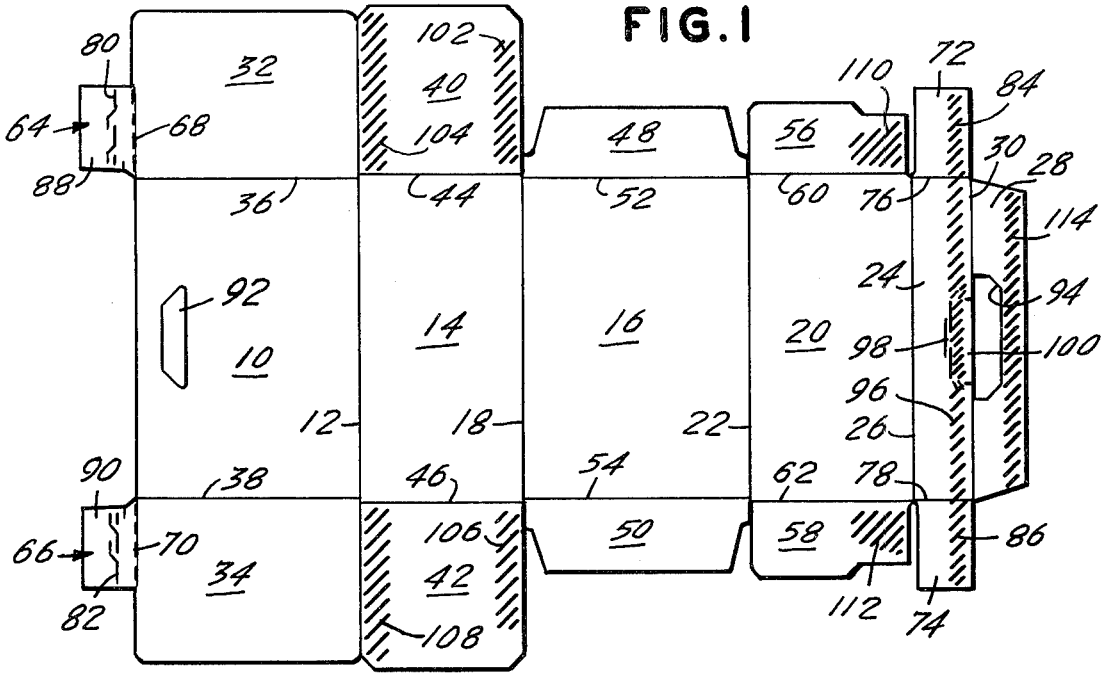
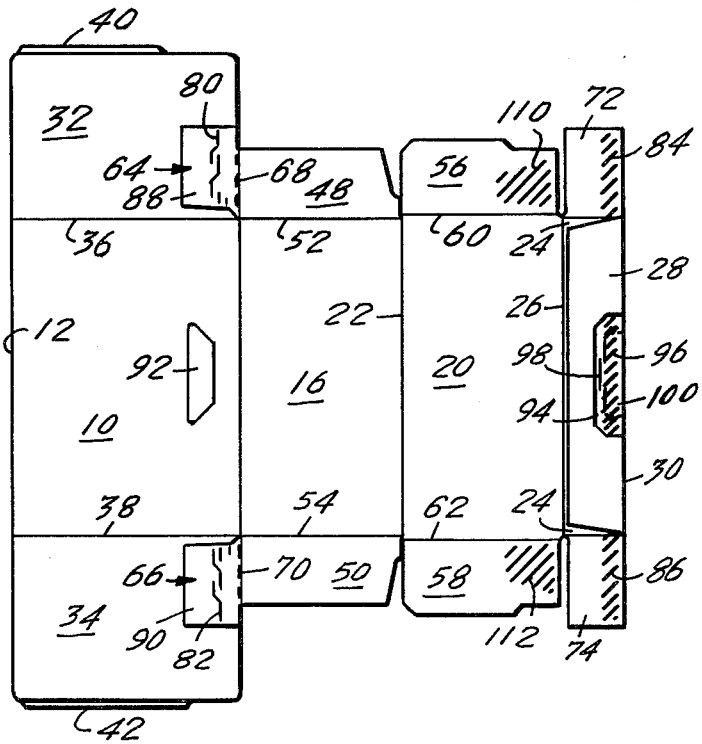
FIG. 2
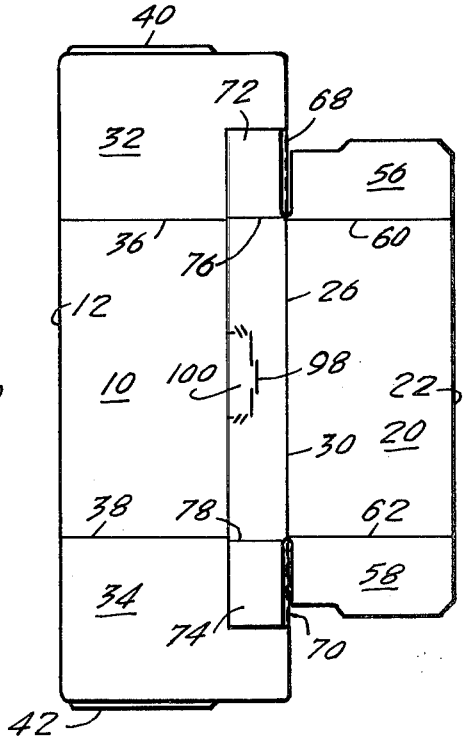
FIG. 3

TAMPERPROOF RECLOSABLE CARTON

BACKGROUND OF THE INVENTION

Reclosable paperboard containers, commonly called "flip-top" cartons, are well known in the art, and are widely employed for the packaging of a variety of food products. As shown in the U.S. Pat. No. Re. 26,471, certain of such cartons are provided with a locking reclosure feature, wherein parts of tabs disposed at the front of the receptacle and cover portions of the carton are brought into engagement with one another upon reclosure. The tabs from which the locking parts are produced exist in the unopened carton as unitary elements, which are divided by lines of weakness formed thereacross. In the course of opening the carton, the lines of weakness are ruptured, the rupture being accomplished effectively through a toggle-like action which is produced in the locking tabs.

Characteristic of the prior art cartons of this sort is the location of the severable locking tabs behind a continuous short skirt, which depends from the cover top panel and extends entirely across the carton; the skirt provides the handle by which opening is effected. Since it remains intact after opening, the skirt hides the locking tabs, thereby hampering visual inspection of the conditions of the container for the purpose of determining whether or not it has been tampered with.

To combat that problem, it is proposed to provide a removable section in the outermost layer of the cover skirt, which will be torn away by any attempt to open the package, thus providing clear evidence of tampering. This requires, of course, that the removable section be secured to the receptable portion of the carton, so that it will be displaced by opening. While such securement is desirable not only from the standpoint of affording tamper resistance, but also to minimize the outward bowing of the skirt which as would otherwise tend to occur, it also inhibits the desirable toggle action of any locking tab disposed thereunder. Such toggle action is further inhibited when the contents of the carton are solid (as in the case of ice cream) since virtually no movement thereinto is possible.

In accordance with the instant invention, it was found that locating the locking tabs at the sides rather than the front of the carton enables the incorporation of a tamperproof feature, without inhibiting the toggle action which facilitates opening. However, unless special measures are taken, doing so would entail the presence of an excessive number of material plies at the upper front corners of the package. Not only would too many plies create a high level of stress at those corner locations, causing a tendency for intolerable cracking to occur in the outermost ply of material, but also an excessive number of plies causes undesirable bowing of the cover skirt.

Accordingly, it is an object of the present invention to provide a novel paperboard carton having a locking reclosure feature, and to provide the blank from which it may be produced.

It is also an object of the invention to provide such a carton and blank in which a tamperproof feature is provided.

Another object of the invention is to provide a carton and blank having the foregoing features and advantages, wherein the tendency for bowing and for cracking of the paperboard in the skirt corner areas is minimized.

A further object is to provide such a blank which is especially adapted for convenient glueing and setting-up on conventional machinery, utilizing a minimum number of operations.

Still another object is to provide a carton of the foregoing sort which is especially suited for the packaging of hard products, such as ice cream.

SUMMARY OF THE DISCLOSURE

It has now been found that certain of the foregoing and related objects of the invention are readily attained in a carton which is integrally formed from a paperboard blank, and which comprises a receptacle portion and a cover portion. The receptacle portion has a rectangular top opening, and includes a front panel, a bottom panel and a pair of end panels hingedly connected thereto and extending rearwardly therefrom, and a rear panel extending upwardly from the bottom panel and hingedly connected thereto. Each of the end panels has, at a point adjacent its hinge, a locking tab extending from the upper edge thereof, hingedly connected thereto, and reversely folded to lie thereagainst, with the tab being transversely scored, or weakened, outwardly of its hinge connection. The cover portion includes a top panel and a relatively narrow skirt member, the top panel being hingedly connected to the upper edge of the rear panel of the receptacle portion, and being dimensioned and configured to overlie and close the opening thereof. The skirt member is comprised of a front flap, a pair of end tabs, and a reinforcing flap. In the skirt member, the front flap is hingedly connected to and depends from the forward edge of the top panel of the cover portion, and extends entirely across the front panel of the receptacle portion. The end tabs are hingedly connected to the ends of the front flap, with one of them extending rearwardly therefrom over each of the end panels of the receptacle portion. When so disposed, each locking tab is interposed between the corresponding end tab and the end panel with which it is associated, and it is secured to the end tab in an area confined to the portion of the locking tab lying outwardly of its line of weakness. The reinforcing flap extends from the lower edge of the front flap, it is hingedly connected thereto, and it is reversely folded and secured thereagainst. Being dimensioned and configured similarly to the front flap, the reinforcing flap is substantially coextensive therewith.

In preferred embodiments, the ends of the reinforcing flap lie generally inwardly of the hinges connecting the end tabs to the front flap, and the locking tabs lie outwardly thereof, thus providing a gap beneath those hinges. Generally, the front flap will have a removable section defined therein by a line of weakness, and the reinforcing flap will have a window formed therein in registry with the removable section of the front flap, with the front flap being secured to the front panel of the receptacle portion through the window of the reinforcing flap. Most desirably, the removable section and window will have a common boundary on the hinge line between the front flap and the reinforcing flap.

Other objects of the invention are attained in an integrally formed paperboard blank adapted for formation into a carton. The blank comprises a rectangular front panel, a pair of end panels disposed at the transversely extending opposite edges of the front panel and hingedly connected thereto, and a pair of locking tabs. One of the tabs extends outwardly, beyond one of the longitudinally extending edges of the front panel, from each of the end panels at a location adjacent its hinge connection to the front panel; the locking tabs are hingedly connected, and have a line of weakness extending thereacross in a direction generally parallel to their hinges. The blank also comprises a rectangular bottom panel hingedly connected along one edge to the other longitudinally extending edge (i. e., the edge opposite to that beyond which the locking tabs extend) of the front panel; a rectangular rear panel hingedly connected at one edge to the opposite edge of the bottom panel; a rectangular top panel hingedly connected at one edge to the opposite edge of the rear panel; a narrow front flap hingedly connected at one edge to the opposite edge of the top panel; a reinforcing flap hingedly connected along one edge to the opposite edge of the front flap; and a pair of end tabs hingedly connected at the free opposite ends of the front flap. The front flap has a removable section defined therein by a line of weakness; the reinforcing flap is dimensioned and configured similarly to the front flap, to lie generally coextensively therewith when folded thereupon, and it has a window formed therein disposed to register with the removable section of the front flap in the folded relationship. In the blank, the front, bottom, rear and top panels, the front flap and the reinforcing flap are all of substantially the same length.

In preferred embodiments of the blank, the distance between the locking tabs is greater than the length of the several panels and flaps, to space each of the tabs from the adjacent end of the forward extension, with the spaces lying generally beneath the hinge connections of the end tabs, when the blank is formed into a carton. Most desirably, the blank will be provided with a continuous, rectilinear line of adhesive on its intended inner surface, the line extending longitudinally along the front flap and the end tabs, and being disposed to register with a window of the reinforcing flap in its folded relationship. The reinforcing flap is thereby adapted to mask portions of the line of adhesive while leaving others exposed, the exposed "other" portions being limited substantially to the end tabs and to a removable section defined in the front flap for registry with the window.

BRIEF DESCRIPTION OF THE DRAWINGS

FIG. 1 is a plan view of a blank embodying the present invention;

FIG. 2 is a plan view of the blank of FIG. 1, with portions thereof disposed in a folded relationship;

FIG. 3 is a plan view of the same blank in a further folded disposition;

DETAILED DESCRIPTION OF THE ILLUSTRATED EMBODIMENT

Figure 4:
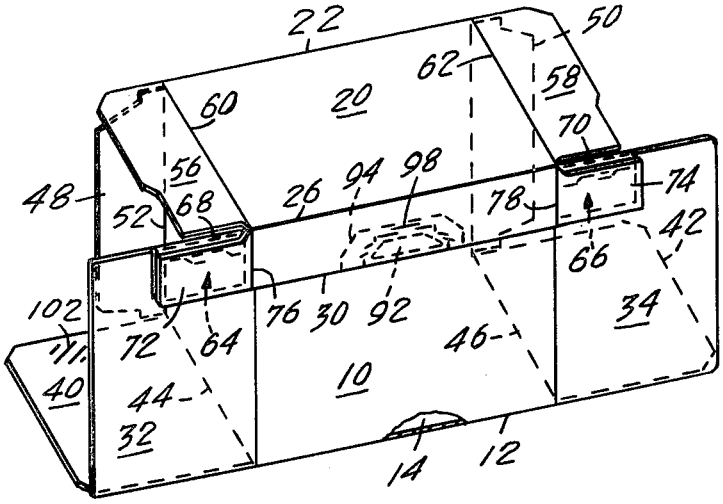
FIG. 4 is a perspective view of the blank, partially set-up as a carton.
Figure 8:
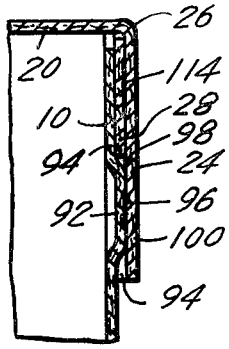
FIG. 8 is an enlarged vertical sectional view taken along line 8—8 of FIG. 6.

Turning now in detail to FIGS. 1-3 of the appended drawings, therein illustrated is a carton blank embodying the present invention, and consisting of integrally formed, hingedly interconnected panels, tabs and flaps. More particularly, the blank consists of front panel 10 connected by hinge 12 to bottom panel 14, rear panel 16 connected to bottom panel 14 by hinge 18, and top panel 20 joined by hinge 22 to rear panel 16. Connected to top panel 20 by hinge 26 is a front flap 24, and a reinforcing flap 28 is joined to flap 24 by hinge 30.

Extending from the opposite sides of the front panel 10 are end panels 32, 34, which are connected thereto by hinges 36,38 respectively. Similarly, end panels 40,42 are joined to bottom panel 14 by hinges 44,46, and end tabs 48,50,56,58 extend from rear panel 16 and top panel 20, and are joined thereto by hinges 50,52,58,60. Locking tabs 64,66 extend from end panels 32,34, respectively, with fold lines 68,70 therebetween and with lines of weakness 80,82 extending thereacross. End tabs 72,74 are attached to the front flap 24 by hinges 76,78, and they extend outwardly therefrom.

An embossed area 92 is formed on the front panel 10, and a corresponding window 94 is cut from reinforcing flap 28; lines of weakness 90 define a removable section 100 in the front flap 24 which, as will hereinafter be described, corresponds to the embossed area 92 and the window 94. Finally, appropriate glue strips and patches 84,86,96,102,104,106,108,110,112,114 are provided on the blank.

Figure 10:
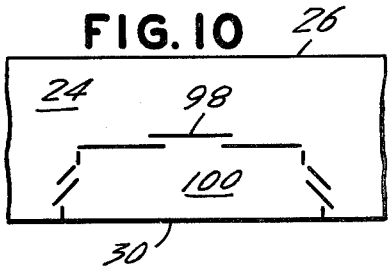
FIG. 10 is an enlarged, fragmentary elevational view of the central portion of the skirt member of the carton.

In FIG. 2, the front panel 10 has been folded over the bottom panel 14, the locking tabs 64,66 have been folded against the end panels 32,34, and the reinforcing flap 28 has been folded over the front flap 24, the latter elements being secured together to provide a reinforced skirt member on the cover portion. In FIG. 3, the top panel 20 has been folded over the rear panel 16, disposing the skirt member over front panel 10. In that position, the removable section 100 defined on the front flap 24 is bonded to the embossed area 92 of the front panel 10 through the window 94, as is best illustrated in FIG. 10. The end tabs 72,74 are also bonded to the exposed surfaces of the locking tabs 64,66, it being appreciated that, because of the limited width of the glue strips 84,86, only the outermost portions 88,90, which lie beyond the lines of weakness 80,82 on the locking tabs 64,66, will be secured to the tabs 72,74.

A notable feature of the blank illustrated resides in the glue patterns on the front flap 24 and the reinforcing flap 28, which cooperate with the configurations of those elements to define selected bond areas. Thus, the glue strip 114 ensures secure bonding of the flap 28 to the flap 24; the configuration of the flap 28 and the location of the window 94 formed therein permit exposure of limited sections 84,86,96 of the glue strip provided on the flap 24 and the end tabs 72,74, thereby producing adhesion only where desired (i.e., on the tabs 72,74 and the removable section 100). These relationships significantly simplify the glueing and folding operations necessary to set-up the carton.

Figure 5:
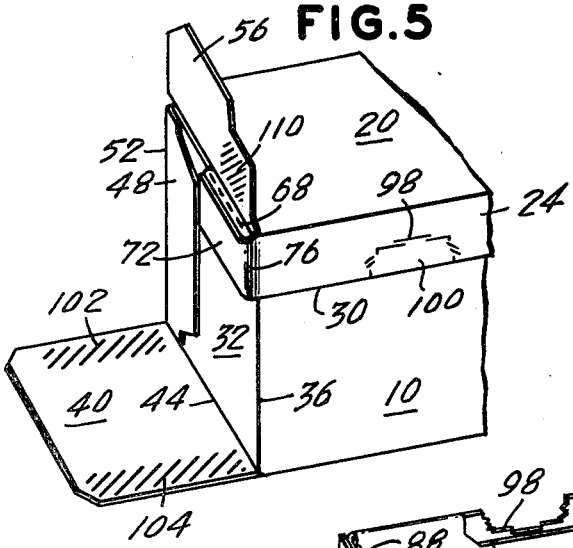
FIG. 5 is a fragmentary perspective view of the carton, showing certain of the end flaps and tabs folded inwardly.
Figure 6:
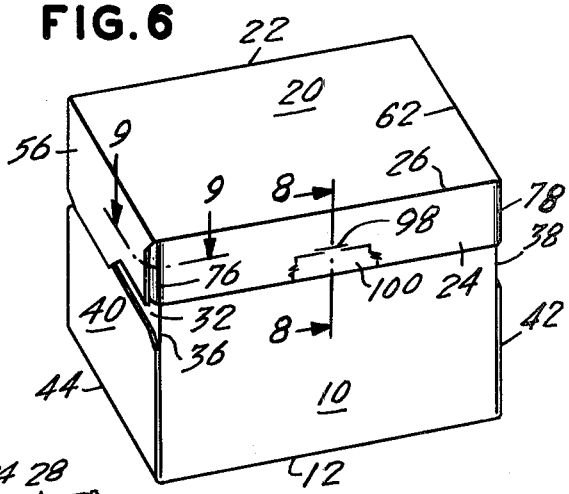
FIG. 6 is a perspective view of the fully set-up carton.

FIG. 4 shows the blank of FIG. 3 formed into a three-dimensional shape, and FIG. 5 shows the end panels 32,34 and consequently, the end tabs 72,74 of front flap 24, folded rearwardly, with the end tabs 48,50 of rear panel 10 folded forwardly thereover. Finally, as depicted in FIG. 6, the end panels 40,42 of the bottom panel 14, and the end tabs 56,58 of the top panel 20, are folded upwardly and downwardly, respectively, to complete the carton, with appropriate bonding being obtained by the glue strips and patches provided. Of course, it will be appreciated that the product will have been introduced into the carton at an appropriate point during the setting-up operations, generally when one end has been formed and sealed.

Figure 7:
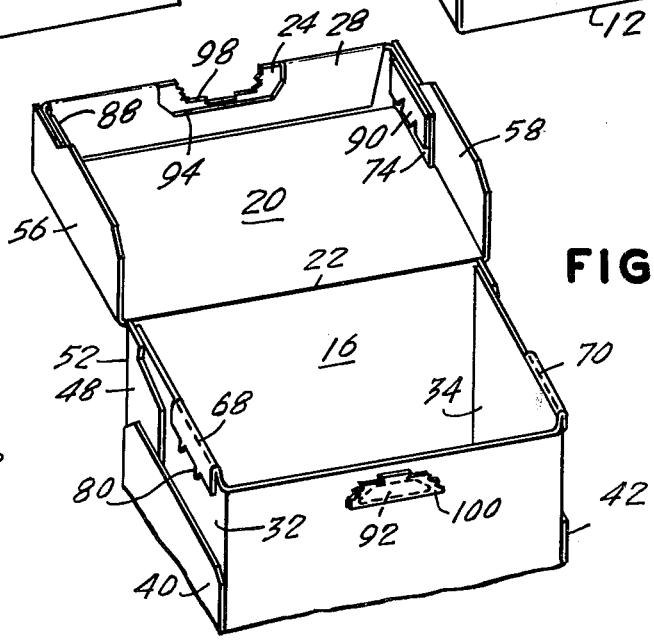
FIG. 7 is a fragmentary perspective view of the open carton.

In FIG. 7, the carbon has been opened, thereby best illustrating its two main parts, i.e., the receptacle portion (comprised essentially of the front, bottom and rear panels 10,14,16 and associated end panels and tabs), and the cover portion (comprises essentially of top panel 20 and the skirt member, which, is, in turn, provided by the front flap 24, the reinforcing flap 28, and the associated end tabs). It will be noted that, upon opening of the carton, the removable section 100 of the front flap 24 remains secured on the front panel 10, thereby evidencing displacement of the cover, even though it may be returned to its original position. It will also be noted that opening of the carton splits the locking tabs 64,66 into two pieces along the lines of weakness 80,82. The inner portions (unnumbered) remain hingedly connected to the end panels 32,34, while the outer portions 88,90 remain secured to the cover portion of the carton. Upon reclosure, the two halves of the locking tabs are brought into engagement with one another, thus producing an effective but temporary lock against inadvertent opening.

Figure 9:
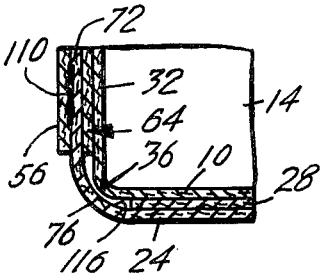
FIG. 9 is an enlarged horizontal sectional view taken along line 9—9 of FIG. 6.

In FIG. 9, the advantageous relationships which exist between the layers of paperboard present in the upper front corners of the carton are most clearly depicted. Specifically, because the locking tabs 64,66 are spaced from the hinges 36,38, and because of the slight taper of the ends of the reinforcing flap 28, gaps 116 are defined therebetween and beneath the hinges 76,78 (only the construction at hinge 76 being illustrated). As a result, just one thickness of material must be traversed by the tabs 72,74 upon rearward folding, thereby generating a minimum amount of stress at the hinges 76,78. Consequently, there is a significantly reduced tendency for bulging and cracking of the material to occur thereat, producing a sounder and more aesthetic carton.

Thus, it can be seen that the present invention provides a novel paperboard flip-top carton having a locking reclosure feature, and the blank from which it may be produced, which carton and blank may additionally be provided with a tamperproof feature. In the subject articles, the tendency for bowing and for cracking of the paperboard in the skirt corner areas is minimized; the blank is especially adapted for convenient glueing and setting-up on conventional machinery, utilizing a minimum number of operations; and the carton is especially suited for the packaging of hard products, such as ice cream.

Having thus described the invention, I claim:

1. A carton integrally formed from a paperboard blank comprising:

a receptacle portion having a rectangular top opening and including a front panel, a bottom panel and a pair of end panels hingedly connected thereto and extending rearwardly therefrom, and a rear panel extending upwardly from said bottom panel and hingedly connected thereto, each of said end panels having, at a point adjacent its hinge, a locking tab extending from the upper edge thereof, hingedly connected thereto, and reversely folded to lie thereagainst, said tab having a transversely extending line of weakness located outwardly of said hinge connection thereof; and a cover portion, including a top panel hingedly connected to the upper edge of said rear panel of said receptacle portion and dimensioned and configured to overlie and close the opening thereof, and a relatively narrow skirt member, comprised of: (a) a front flap hingedly connected to and depending from the forward edge of said top panel and extending entirely across said front panel of said receptacle portion, (b) a pair of end tabs hingedly connected to the ends of said front flap with each of said end tabs extending rearwardly therefrom over the corresponding one of said end panels of said receptacle portion, with said corresponding locking tab thereof interposed therebetween and secured to said corresponding end tab, the securement of said locking tab to said end tab being confined to the portion thereof lying outwardly of said line of weakness, and (c) a reinforcing flap extending from the lower edge of said front flap, hingedly connected thereto, and reversely folded and secured thereagainst, said reinforcing flap being dimensioned and configured similarly to said front flap to be substantially coextensive therewith.

2. The carton of claim 1 wherein the ends of said reinforcing flap lie generally inwardly of the hinges connecting said end tabs to said front flap, and wherein said locking tabs lie outwardly thereof, to provide a gap beneath said hinges.

3. The carton of claim 1 wherein said front flap has a removable section defined therein by a line of weakness, and wherein said reinforcing flap has a window formed therein in registry with said removable section of said front flap, said front flap being secured to said front panel of said receptacle portion through said window of said reinforcing flap.

4. The carton of claim 3 wherein said removable section and said window have a common boundary on the hinge line between said front flap and said reinforcing flap.

5. An integrally formed paperboard blank adapted for formation into a carton, comprising:

a rectangular front panel;

a pair of end panels disposed at the transversely extending opposite edges of said front panel and hingedly connected thereto;

a pair of locking tabs, each of which extends outwardly beyond one of the longitudinally extending edges of said front panel from the corresponding one of said end panels at a location adjacent said hinge connection to each of said front panel, said locking tabs being hingedly connected to one of said end panels and having a line of weakness extending thereacross in a direction generally parallel to said hinge thereof;

a rectangular bottom panel hingedly connected along one edge to the other longitudinally extending edge of said front panel;

a rectangular rear panel hingedly connected at one edge to the opposite edge of said bottom panel;

a rectangular top panel hingedly connected at one edge to the opposite edge of said rear panel;

a narrow front flap hingedly connected at one edge to the opposite edge of said top panel, and having a removable section defined therein by a line of weakness;

a reinforcing flap hingedly connected along one edge to the opposite edge of said front flap, and being dimensioned and configured similarly thereto to lie generally coextensively therewith when folded thereupon, said reinforcing flap having a window formed therein disposed to register with said removable section of said front flap in the folded relationship; and a pair of end tabs hingedly connected at the free opposite ends of said front flap, said front, bottom, rear and top panels, said front flap and said reinforcing flap all being of substantially the same length.

6. The blank of claim 5 wherein the distance between said locking tabs is greater than said length so that, when said blank is formed into a carton, each of said locking tabs is spaced from the adjacent end of said forward extension with said spaces lying generally beneath said hinge connections of said end tabs.

7. The blank of claim 5 wherein said front flap has a removable section defined therein by a line of weakness and wherein said reinforcing flap has a window formed therein, said window being disposed to register with said removable section of said front flap when said reinforcing flap is so folded.

8. The blank of claim 7 wherein a continuous rectilinear line of adhesive is provided on the intended inner surface thereof, said line of adhesive extending longitudinally along said front flap and said end tabs and being disposed to register with said window of said reinforcing flap in said folded relationship thereof, said reinforcing flap thereby being adapted to mask portions of said line of adhesive and to leave other portions exposed, said other portions being limited substantially to said end tabs and said removable section of said front flap.

* * * * *